United States Patent [19]

Rohr et al.

[11] Patent Number: 5,065,911

[45] Date of Patent: Nov. 19, 1991

[54] TWO-PIECE DISPENSING CLOSURE WITH CANTILEVERED BIASING MEMBER

[75] Inventors: Robert D. Rohr, Elgin, Ill.; Lawrence R. Kitterman, Bradenton. Fla.

[73] Assignee: Seaquist Closures, Crystal Lake, Ill.

[21] Appl. No.: 523,133

[22] Filed: May 14, 1990

[51] Int. Cl.[5] ..... B67D 3/00

[52] U.S. Cl. ..... 222/517; 215/235; 215/238; 222/556

[58] Field of Search ..... 222/498, 517, 546, 556; 215/235, 238; 220/254, 259, 335, 338

[56] References Cited

U.S. PATENT DOCUMENTS

| | | | |
|---|---|---|---|
| Re. 30,861 | 2/1982 | Krawagna | 16/293 |
| 2,342,477 | 2/1944 | Magnenat | 220/31 |
| 2,734,222 | 2/1956 | Kiba | 16/128 |
| 2,833,447 | 5/1958 | Thiele | 222/151 |
| 2,889,087 | 6/1959 | Paull et al. | 222/498 |
| 2,960,254 | 11/1960 | Kiba | 220/31 |
| 3,120,879 | 2/1964 | Warner | 184/91 |
| 3,201,011 | 8/1965 | Brocken | 222/473 |
| 3,289,877 | 12/1966 | Wolf | 220/31 |
| 3,300,104 | 1/1967 | Burt | 222/482 |
| 3,628,215 | 12/1971 | Everburg | 16/150 |
| 3,752,371 | 8/1973 | Susuki et al. | 222/182 |
| 3,853,250 | 12/1974 | Alpern | 222/517 |
| 4,010,875 | 3/1977 | Babiol | 222/517 |
| 4,086,686 | 5/1978 | Takabayashi | 24/250 |
| 4,124,151 | 11/1978 | Hazard | 222/498 |
| 4,158,902 | 6/1979 | Chernack et al. | 16/150 |
| 4,170,315 | 10/1979 | Dubach et al. | 220/281 |
| 4,172,540 | 10/1979 | Erichson | 222/517 |
| 4,193,519 | 3/1980 | Dubach et al. | 222/111 |
| 4,219,138 | 8/1980 | Hazard | 222/534 |
| 4,220,248 | 9/1980 | Wilson et al. | 215/235 |
| 4,261,486 | 4/1981 | Bush et al. | 222/517 |
| 4,282,991 | 8/1981 | Hazard | 222/531 |
| 4,291,818 | 9/1981 | Nozawa et al. | 220/335 |
| 4,346,810 | 8/1982 | Kneissl | 215/237 |
| 4,377,247 | 3/1983 | Hazard et al. | 222/517 |
| 4,399,928 | 8/1983 | Klinger | 220/335 |
| 4,402,435 | 9/1983 | Libit | 222/556 |
| 4,403,712 | 9/1983 | Wiesinger | 220/339 |
| 4,441,637 | 4/1984 | Libit | 222/556 |
| 4,545,495 | 10/1985 | Kinsley | 215/235 |
| 4,615,462 | 10/1986 | Sacherer et al. | 220/339 |
| 4,625,898 | 12/1986 | Hazard | 222/517 |
| 4,632,266 | 12/1986 | Osswald | 215/235 |
| 4,645,086 | 2/1987 | Rosenthal | 215/235 |
| 4,666,068 | 5/1987 | Bush | 222/546 |
| 4,700,858 | 10/1987 | Bennett | 215/237 |
| 4,717,050 | 1/1988 | Wright | 220/259 X |
| 4,742,928 | 5/1988 | Braun | 215/235 |
| 4,747,498 | 5/1988 | Gach | 215/235 X |
| 4,776,501 | 10/1988 | Ostrowsky | 222/517 |
| 4,778,071 | 10/1988 | Fillmore | 220/335 X |
| 4,813,560 | 3/1989 | Begley | 222/517 X |
| 4,821,899 | 4/1989 | Nycz et al. | 215/235 |

FOREIGN PATENT DOCUMENTS

| | | | |
|---|---|---|---|
| 2120079 | 11/1972 | Fed. Rep. of Germany | 220/239 |
| 449737 | 6/1949 | Italy | 222/517 |
| 1056999 | 2/1967 | United Kingdom . | |

*Primary Examiner*—Michael S. Huppert
*Assistant Examiner*—Joseph A. Kaufman
*Attorney, Agent, or Firm*—Dressler, Goldsmith, Shore, Sutker & Milnamow, Ltd.

[57] ABSTRACT

A closure is provided for use on a container. The closure includes a body for being mounted to the container over the container opening and defines a dispensing orifice. A separate lid is mounted on the body for pivoting between a closed position and an open position. A resiliently deformable biasing member extends from the lid and has a distal end for engaging the body. Restraining walls are provided on the body for restraining the distal end of the biasing member whereby the biasing member is most stressed when the lid is at an over center position between the open and closed positions to thereby bias the lid toward one of the open and closed positions.

11 Claims, 2 Drawing Sheets

Fig. 1
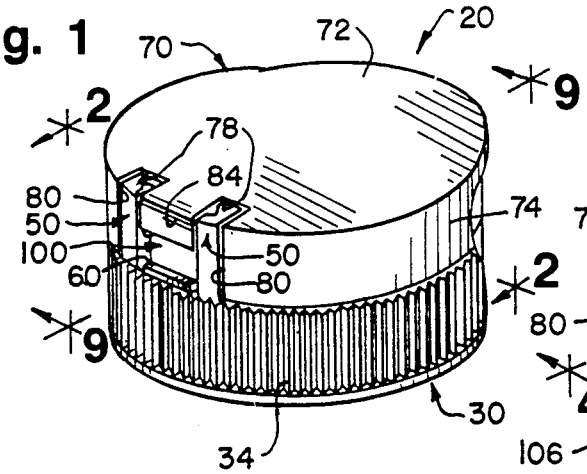
Fig 3
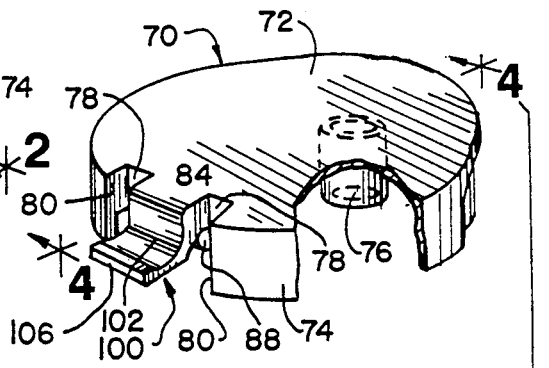
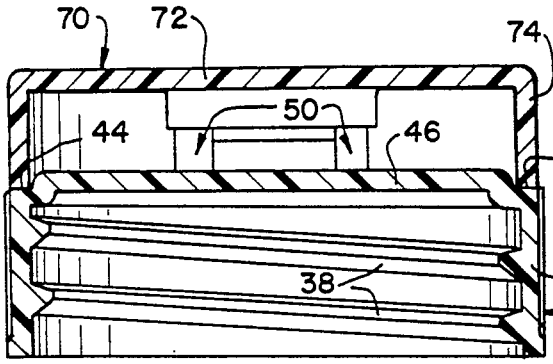
Fig. 2
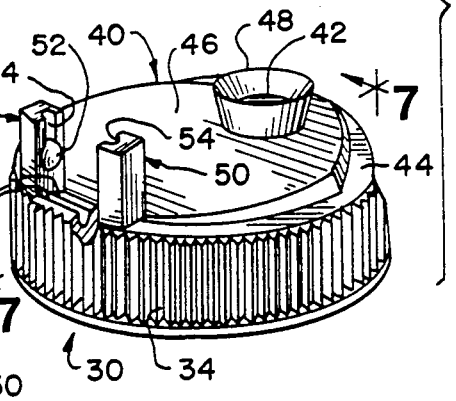
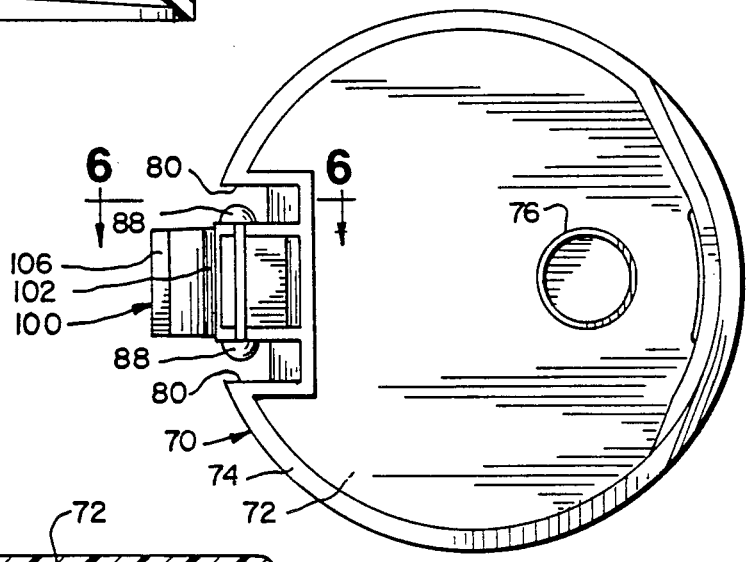
Fig. 5
Fig. 4
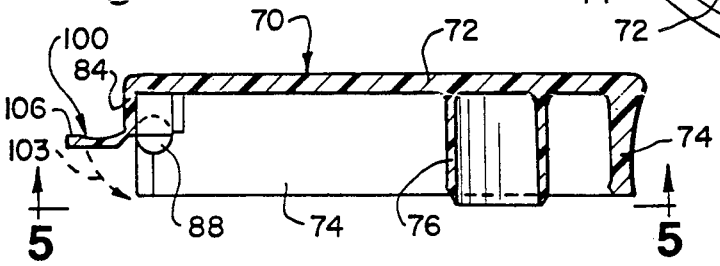

Fig. 6
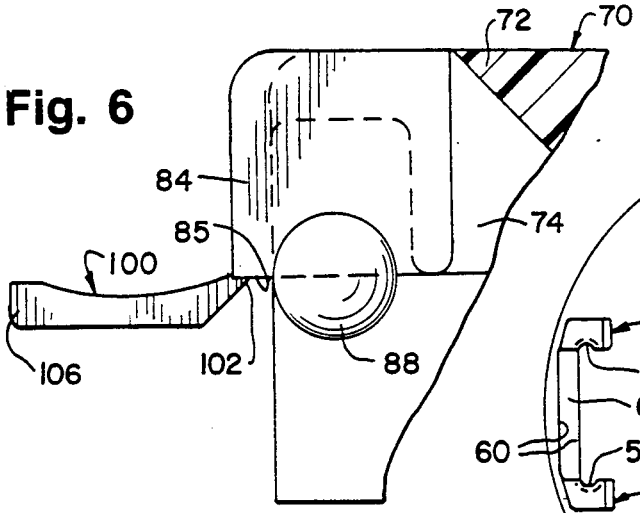
Fig. 8
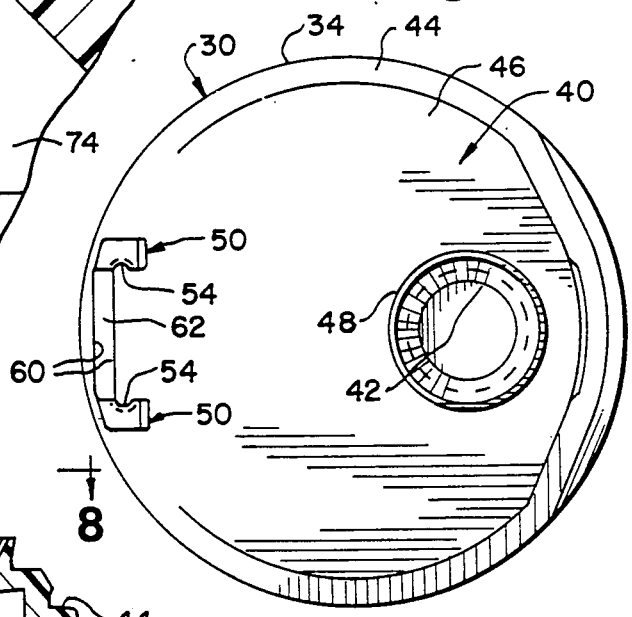
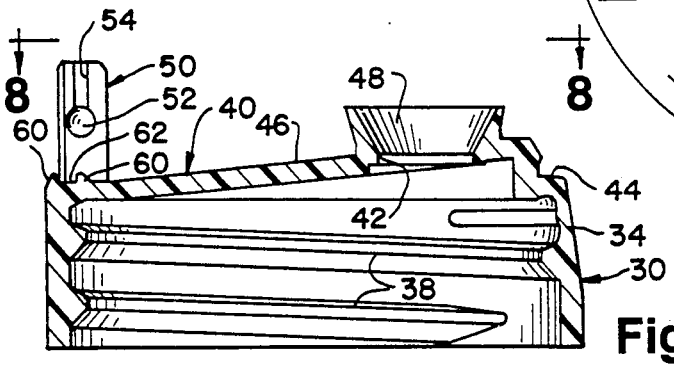
Fig. 7
Fig. 9
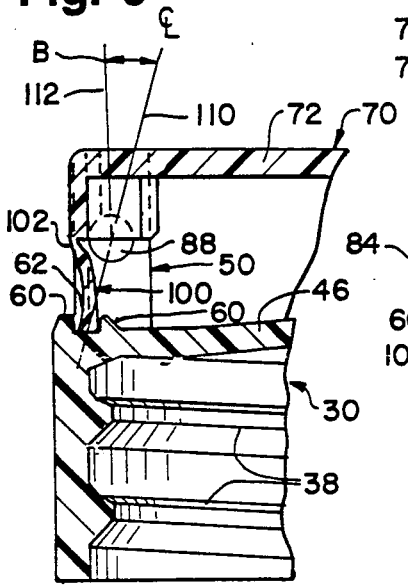
Fig. 10
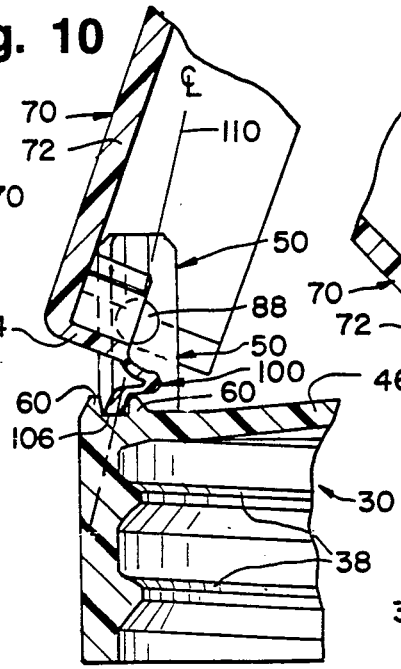
Fig. 11
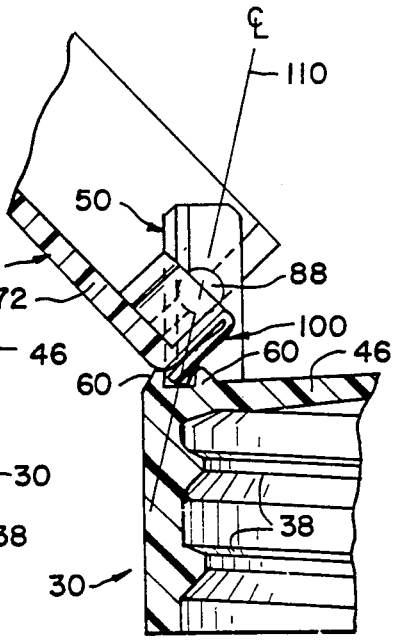

TWO-PIECE DISPENSING CLOSURE WITH CANTILEVERED BIASING MEMBER

TECHNICAL FIELD

This invention relates to a closure for use on the open end of a container from which the liquid contents can be dispensed.

BACKGROUND OF THE INVENTION AND TECHNICAL PROBLEMS POSED BY THE PRIOR ART

A variety of closure designs have been proposed over the years for use with a container wherein the closure includes two pieces that can be manipulated between open and closed positions for permitting or preventing the dispensing of a product from the container. Some such closures have means for biasing a lid to the closed or open positions to provide a so-called snap-action effect. These closures having varying degrees of effectiveness in moving the lid with sufficient force to the desired open and closed positions.

It would be desirable to provide an improved type of two-piece closure having a highly effective snap-action movement of the lid between the closed and open positions from the bistable over center position.

Further, it would be advantageous if such an improved closure could be designed to facilitate relatively easy and inexpensive fabrication of the separate pieces.

It would also be desirable if the separate pieces of such an improved closure could be rapidly assembled with a minimal amount of manipulation and with little or no possibility of misalignment or improper engagement of the pieces.

SUMMARY OF THE INVENTION

A closure is provided for use on a container defining an opening communicating with the container interior.

The closure includes a body for being mounted to the container over the container opening. The body defines a dispensing orifice communicating at the container opening with the container interior.

A separate lid is provided along with means for mounting the lid on the body for pivoting between (1) a closed position occluding the dispensing orifice and (2) an open position spaced away from the dispensing orifice.

A resiliently deformable biasing member extends from either the lid or the body and has a distal end for engaging the other of the lid and body. In a preferred embodiment, the biasing member is connected through a flexible film hinge or living hinge to the lid so that it is unitary with the lid.

A restraining means is provided for restraining the distal end of the biasing member. In the preferred embodiment wherein the biasing member extends from the lid, the restraining means is provided in the body. In the preferred form of the invention, the restraining means includes a pair of spaced-apart restraining walls defining an upwardly open channel for receiving the distal end of the biasing member. The biasing member is most stressed when the lid is at an over center point between the open and closed positions to thereby bias the lid toward one of the open and closed positions.

This novel two-piece closure has been found to provide a highly effective snap-action movement, and the lid piece and body piece forming the closure can be easily fabricated and rapidly assembled with a minimal amount of manipulation and with little or no possibility of misalignment or improper engagement of the pieces.

Numerous other advantages and features of the present invention will become readily apparent from the following detailed description of the invention, from the claims, and from the accompanying drawings.

BRIEF DESCRIPTION OF THE DRAWINGS

In the accompanying drawings forming part of the specification, in which like numerals are employed to designate like parts throughout the same, FIG. 1 is a perspective view of the closure of the present invention shown in a closed orientation prior to being installed on a container (not illustrated);

FIG. 2 is a greatly enlarged, cross-sectional view taken generally along the plane 2—2 in FIG. 1;

FIG. 3 is an exploded, perspective view of the closure illustrated in FIG. 1 with portions of the structure broken away to illustrate interior detail and with the biasing member on the lid oriented in the asmolded position;

FIG. 4 is a enlarged, cross-sectional view taken generally along the plane 4—4 in FIG. 3;

FIG. 5 is an enlarged, bottom plan view of the under side of the lid separated from the body and taken generally along the plane 5—5 in FIG. 4;

FIG. 6 is a greatly enlarged, fragmentary, partial cross-sectional view taken along the plane 6—6 in FIG. 5;

FIG. 7 is an enlarged, cross-sectional view of the closure body taken generally along the plane 7—7 in FIG. 3;

FIG. 8 is a top plan view of the closure body taken generally along the plane 8—8 in FIG. 7;

FIG. 9 is a greatly enlarged, fragmentary, partial cross-sectional view taken generally along the plane 9—9 in FIG. 1 and showing the lid in the fully closed position;

FIG. 10 is a view similar to FIG. 9 but showing the lid open to the bistable over center position; and FIG. 11 is a view similar to FIGS. 9 and 10 but showing the lid fully open.

DESCRIPTION OF THE PREFERRED EMBODIMENT

While this invention is susceptible of embodiment in many different forms, this specification and the accompanying drawings disclose only one specific form as an example of the use of the invention. The invention is not intended to be limited to the embodiment so described, and the scope of the invention will be pointed out in the appended claims.

For ease of description, the closure of the invention is described in a position as it is usually encountered—upright on a container, and terms such as upper, lower, vertical, horizontal, etc. are used with reference to this position notwithstanding the fact that the container and closure may be used in other positions.

With reference now to the figures, especially FIGS. 1 and 2, the closure of the present invention is represented generally by the numeral 20. The closure 20 is adapted to be disposed on a container (not illustrated) such as the typical container which has a conventional mouth or opening defined by a neck or other suitable structure. The closure 20 may be fabricated from a synthetic thermoplastic material, or other materials, compatible with the container contents.

As best illustrated in FIGS. 2 and 3, the closure 20 includes a body means or body 30 for securement to the container. In the illustrated embodiment, the body 30 includes a peripheral wall in the form of a cylindrical skirt 34.

As best illustrated in FIG. 2, the closure body skirt 34 includes, on its interior surface, a conventional thread 38 or other suitable means (e.g., a snap-fit bead (not illustrated)) for engaging suitable cooperating means on the container neck to releasably secure the body 30 to the container.

In the preferred embodiment illustrated, the closure body 30 includes a transverse wall 40 which defines a dispensing orifice 42 (FIGS. 3, 7, and 8). The transverse wall 40 includes a peripheral rim portion 44 and an upwardly angled central portion 46. The dispensing orifice 42 penetrates the upwardly angled central portion 46 and is surrounded by an outwardly flaring collar 48 projecting upwardly from the central portion 46.

The body 30 also includes a pair of spaced-apart receiving means or posts 50 (FIGS. 3, 7, and 8), and each post 50 defines a bearing cavity 52 facing toward the bearing cavity 52 in the other post 50. In the preferred embodiment illustrated, each cavity 52 is defined in one of the posts 50 below the post top end, and each post 50 further defines a vertical channel 54 extending from the post top end downwardly to the bearing cavity 52.

The body 30 further includes a restraining means in the form of two upwardly extending, spaced-apart, parallel restraining walls or members 60 which define between them an upwardly open channel 62.

The closure 20 includes a lid 70 which is separate from the closure body 30. The lid 70 is mounted on the closure body 30 for pivoting between a closed position (as illustrated in FIG. 1) and an open position (as illustrated in FIG. 11). The lid 70 includes a generally planar, disc-like top wall 72 and a skirt 74 depending downwardly from the periphery of the top wall 72. Projecting downwardly from the under side of the top wall 72 is a spud or plug 76 which is adapted to be received in the body collar 48 and dispensing orifice 42 for occluding the orifice when the lid 70 is in the fully closed position (FIG. 1).

As best illustrated in FIG. 3, the top wall 72 of the lid 70 defines a pair of spaced-apart notches 78 at its periphery adjacent the skirt 74. The skirt 74 defines a pair of spaced-apart slots 80 (FIGS. 3 and 5). Each skirt slot 80 is aligned with, and communicates with, one of the lid top wall notches 78 as best shown in FIG. 3.

Between the notches 78 and slots 80 in the lid 70, there is a support wall section 84 (FIGS. 1, 3, 4 and 6). As best illustrated in FIG. 6, the support wall section 84 terminates in a bottom edge 85 above the bottom of the lid skirt 74. When the lid 70 is properly positioned on the body 30, the support wall section 84 is received between the body posts 50 which are in turn received within the lid notches 78 and slots 80 on either side of the support wall section 84.

The support wall section 84 includes a pair of oppositely directed pivot members 88 (as best shown in FIGS. 2, 4, 6, and 9–11). Each pivot member 88 is adapted to be received within one of the receiving cavities 52 of an adjacent post 50 of the closure body 30. In order to facilitate assembly, the lid 70 may be moved vertically downwardly and toward the closure body 30 so that the pivot members 88 enter the upwardly open channels 54 of the posts 50 and are thereby guided into the receiving cavities 52.

In the preferred form of the invention illustrated, each receiving cavity 52 has a generally hemispherical, concave configuration, and each pivot member 88 has a generally hemispherical, convex configuration. The lower half of each pivot member 88 projects downwardly below the support wall section bottom edge 85 as best illustrated in FIGS. 4 and 6. The pivot members 88 and receiving cavities 52 thus define a pivot axis about which the lid 70 is pivoted relative to the closure body 30.

The pivot members 88 may have other suitable configurations, such as conical configurations, frustrum cone configurations, or cam lobe configurations. The closure body receiving cavities 52 may then have appropriate corresponding shapes. The present invention also contemplates that the cavities 52 may be defined within the lid 70 instead of on the body 30 and that the pivot members 88 may be defined on the closure body 30 instead of on the lid 70.

Further, regardless of whether the closure body 30 has the pivot members or the receiving cavities, the pivot members and receiving cavities may have locations other than illustrated. For example, the posts 50 may, if desired, be positioned further apart from each other (with reference to FIG. 8) and may be supported on structures extending laterally beyond the closure body skirt 34. On the other hand, the posts 50 may be positioned much further away from the dispensing orifice 42 on structures extending rearwardly beyond the skirt 34. In addition, the receiving cavities 52 may be provided in recessed wall portions at or below the closure body transverse wall 40.

The closure 20 provides the pivotally mounted lid 70 with a snap-action operation. To this end, the closure 20 includes a biasing member 100 as best illustrated in FIGS. 3, 4, and 5. In the preferred embodiment illustrated, where at least the closure lid 70 is molded from a thermoplastic material, the biasing member 100 is preferably molded as a unitary extension of the lid 70 and has a rearwardly cantilevered orientation. Preferably, the biasing member 100 is connected with a flexible, living, film hinge 102 to the bottom of the lid support wall section 84. The biasing member 100 and living film hinge 102 may be relatively easily molded with the rest of the lid 70 from thermoplastic material by orienting the biasing member 100 to extend substantially parallel to the parting line of the mold assembly. The biasing member 100 may be characterized as being resiliently or elastically deformable or deflectable.

When the lid 70 is assembled with the body 30 to form the closure 20, the biasing member 100 is initially swung downwardly (as indicated by arrow 103 in FIG. 4) on the hinge 102 to align the member distal end 106 in the channel 62 defined between the two restraining members 60 on the closure body 30.

When the lid 70 is properly seated on the closure body 30 in the fully closed position and when the biasing member 100 is properly restrained between the restraining members 60, the biasing member 100 has a generally vertical orientation as shown in FIG. 9. In this orientation, the living hinge 102 is somewhat stressed, but the length of the biasing member 100 between the hinge 102 and its distal end 106 is substantially unstressed.

With reference to FIG. 9, it will be appreciated that an imaginary plane 110 can be drawn through the pivot axis of the pivot members 88 and through the biasing member distal end 106 which is restrained in the channel 62 between the restraining walls 60. In the preferred embodiment illustrated, the channel 62 is spaced somewhat rearwardly in the closure body 30. More particularly, the channel 62 is offset from a vertical plane 112 that passes through the pivot axis of the lid pivot members 88 and that is also perpendicular to the lid top wall 72.

As the lid 70 is opened (by rotating it counterclockwise about the axis of the pivot members 88 as viewed in FIG. 10), the upper end of the biasing member 100 (which is connected through the living hinge 102 to the lid support wall section 84) moves downwardly and closer to the restrained distal end 106 of the biasing member. This causes the biasing member 100 to deflect, bend, or deform as shown generally in FIG. 10. Owing to the resiliency of the biasing member 100, a reaction force tends to urge the lid 70 to rotate back toward the closed position if the opening force is removed. However, when the lid 70 is opened to an "over center" or "dead center" position as illustrated in FIG. 10, then the end of the biasing member connected to the living hinge 102 lies on the plane 110, and this defines a bistable position at which the biasing member is maximally deformed and where the biasing member 100 is most stressed. In this position, if the opening force were removed from the lid 70, the lid could be forced to pivot either back to the closed position or to the full open position (FIG. 11). On either side of the bistable, over center position illustrated in FIG. 10, the deformation of the biasing member 100 is at least partly reduced, and the lid 70 is thus urged to a stable position at the end of its travel range on that side of the over center position. In this manner, when the lid 70 is closed, it is self-maintained in the closed position. On the other hand, when the lid 70 is open, as illustrated in FIG. 11, it is self-maintained in that open position to accommodate dispensing of the contents without having to use one's fingers to hold the cover out of the way.

The principles of the present invention may be embodied in structural configurations different than those illustrated. For example, a plurality of biasing members 100 may be provided with a plurality of pairs of support posts 50 and pivot members 88.

Further, the length of the biasing member 100 may be increased somewhat so that in the full closed and full opened positions, there is some deformation and stress in the biasing member 100 so as to provide a "pre-load" or "pre-compression" force to hold the lid 70 in the closed or open positions with a predetermined force.

Also, the biasing member 100 may be initially molded in a vertically downwardly extending position. Alternatively, where the biasing member 100 is molded in an initially cantilevered, horizontal position (FIG. 6), the closure body and lid supporting structure may be designed to accommodate the assembly of the body and lid with the biasing member 100 in the cantilevered position. In that arrangement, the members 60 for restraining the biasing member distal end 106 would be elevated and reoriented so as to open laterally toward the pivot members 88. The lid 70 and body 30 would, of course, have to be configured so that, in the closed and open positions of the closure, the living hinge 102 would still be offset from a plane passing through the biasing member distal end 106 and the axis of the pivot members 88.

It will be readily observed from the foregoing detailed description of the invention and from the illustrated embodiment thereof that numerous variations and modifications may be effected without departing from the true spirit and scope of the novel concepts or principles of this invention.

What is claimed is:

1. A two-piece snap-action closure which can be readily assembled for use on a container defining an opening communicating with the container interior, said closure comprising:

a body for being mounted to said container over said container opening, said body defining a dispensing orifice for communicating at said container opening with said container interior;

a lid separate from said body;

mounting means for mounting said lid on said body for pivoting between a closed position occluding said dispensing orifice and an open position spaced away from said dispensing orifice;

a resiliently deformable biasing member extending from a first location on one of said lid and body and having a distal end for engaging the other of said lid and body at a second location, said biasing member having a range of movement with a stable position at each end of the range on either side of an over center point; and restraining means on said other of said lid and body for restraining said distal end of said biasing member at said second location whereby said biasing member is most stressed when said lid is at said over center point between said open and closed positions to thereby bias said lid toward one of said open and closed positions.

2. A two-piece snap-action closure which can be readily assembled for use on a container defining an opening communicating with the container interior, said closure comprising:

a body for being mounted to said container over said container opening, said body defining a dispensing orifice for communicating at said container opening with said container interior;

a lid separate from said body and disposed on said body for pivoting between a closed position occluding said dispensing orifice and an open position spaced away from said dispensing orifice, said lid further including a flexible, living, film hinge and an elastically deformable cantilevered biasing member that extends from said hinge and that has a distal end for engaging said body;

a pair of spaced-apart pivot members on one of said lid and body;

a pair of spaced-apart receiving means on the other of said lid and body for each receiving one of said pivot members to pivotally mount said lid to said body; and said body having a pair of spaced-apart restraining walls for restraining therein said distal end of said biasing member at a predetermined location, the length of said biasing member between said hinge and predetermined location exceeding the straight line distance between said hinge and predetermined location by a maximum amount when said lid is at an over center point between said open and closed positions whereby said biasing member is most stressed to thereby bias said lid toward one of said open and closed positions.

3. A two-piece snap-action closure which can be readily assembled for use on a container defining an opening communicating with the container interior, said closure comprising:

a body for being mounted to said container over said container opening, said body defining a dispensing orifice for communicating at said container opening with said container interior, said body further including a pair of spaced-apart posts, each post defining a bearing cavity facing toward the bearing cavity in the other post, and said body further including upwardly extending restraining members located between said posts;

a lid separate from said body and disposed on said body for pivoting about a pivot axis between a closed position occluding said dispensing orifice and an open position spaced away from said dispensing orifice;

a biasing member connected with a living film hinge to said lid in a cantilevered orientation in the unassembled condition and having a distal end for being received by said body restraining members at a predetermined location when said biasing member is swung on said living film hinge relative to said lid to an assembled orientation, said biasing member being elastically deformable between said distal end and said living film hinge; and a pair of spaced-apart pivot members carried by said lid on said pivot axis for each being received in one of said bearing cavities to pivotally mount said lid to said body so that when said lid is moved between said open and closed positions to a bistable over center position, then said hinge lies between, and on a plane defined by, said pivot axis and said biasing member distal end whereby said biasing member is subjected to maximum stress to thereby bias said cover toward at least one of said open and closed positions.

4. The closure in accordance with claim 2 in which each said receiving means is defined in said body; and each said pivot member is defined on said lid.

5. The closure in accordance with any one of claims 1-3 in which said body defines a transverse wall for supporting said lid; and said transverse wall defines said dispensing orifice.

6. The closure in accordance with any one of claims 1-3 in which said body has a peripheral skirt for being mounted to said container around said container opening; and said body has a transverse wall extending across said peripheral skirt and defining said dispensing orifice.

7. The closure in accordance with claim 3 in which said lid has a generally planar, disc-like top wall and a skirt depending downwardly from the periphery of said top wall, said top wall defining two spaced-apart notches at the periphery, said skirt defining two spaced-apart slots and a support wall section between said slots, each said slot being aligned with and communicating with one of said notches whereby each aligned notch and slot receives one of said posts on either side of said support wall section, said support wall section terminating above the bottom of said skirt, each said pivot member being a hemispherical protrusion carried on a side of said support wall section in one of said slots at said lid pivot axis, said biasing member being connected with said living hinge to the bottom of said support wall section along a hinge axis that is spaced from and parallel to said lid pivot axis.

8. The closure in accordance with claim 7 in which said restraining members on said body define a channel opening upwardly for receiving said distal end of said biasing member; said channel being offset from a plane passing through said pivot axis perpendicular to said lid top wall.

9. The closure in accordance with claim 3 in which each said bearing cavity is defined in one of said posts below the post top end; and each said post defines a vertical channel extending downwardly from the post top end to said bearing cavity.

10. The closure in accordance with claim 1 in which said biasing member extends from a first location on said lid to said distal end engaging said body at a second location; and the length of said biasing member between said first and second locations exceeds the straight line distance between said first and second locations by a maximum amount when said lid is at said over center point between said open and closed positions.

11. The closure in accordance with claim 10 in which said biasing member length is substantially equal to the distance between said first and second locations when said lid is in said closed position so that said biasing member is substantially unstressed when said lid is in said closed position.

* * * * *